United States Patent [19]

McNab et al.

[11] Patent Number: 4,854,202

[45] Date of Patent: Aug. 8, 1989

[54] APPARATUS FOR PROVIDING BEVELED EDGE PADS

[75] Inventors: Donald R. McNab, 4407 S. 173rd, Seattle, Wash. 98188; Floyd D. Smith, Kent, Wash.

[73] Assignee: Donald R. McNab, Seattle, Wash.

[21] Appl. No.: 136,019

[22] Filed: Dec. 21, 1987

[51] Int. Cl.[4] ..... B26D 3/02

[52] U.S. Cl. ..... 83/153; 83/176; 83/388; 83/443; 83/632; 83/694

[58] Field of Search ..... 83/17, 176, 571, 20, 83/439, 443, 561, 562, 925 MG, 632, 694, 18, 19, 175, 153, 388; 412/6, 12, 33

[56] References Cited

U.S. PATENT DOCUMENTS

| | | | |
|---|---|---|---|
| 1,569,390 | 1/1926 | Parker . | |
| 1,866,968 | 7/1932 | Ellison . | |
| 1,932,153 | 10/1933 | Bergendahl . | |
| 2,120,473 | 6/1938 | Shepherdson | 83/176 |
| 2,266,362 | 12/1941 | Forster . | |
| 2,293,721 | 8/1942 | Engler . | |
| 2,361,422 | 10/1944 | Sims et al. . | |
| 2,383,025 | 8/1945 | Taylor . | |
| 2,583,595 | 1/1952 | Rodel et al. . | |
| 2,680,630 | 6/1954 | Machol . | |
| 3,065,657 | 11/1962 | Thompson . | |
| 3,227,025 | 1/1966 | MacMillan . | |
| 3,701,186 | 10/1972 | Kuts . | |
| 3,817,492 | 6/1974 | Raymer . | |
| 4,427,290 | 1/1984 | Kaye et al. . | |

*Primary Examiner*—Frank T. Yost
*Assistant Examiner*—Rinaldi Rada
*Attorney, Agent, or Firm*—Seed and Berry

[57] ABSTRACT

Apparatus and method are disclosed for cutting paper pads to provide a paper pad which has a beveled edge. The apparatus includes a gripping assembly for gripping the pad and a positioning assembly for bending the pad intermediate its ends. A cutting assembly is provided for cutting the pad with a perpendicular cut while it is bent such that when the pad is returned to its original planar configuration, the cut edge will assume beveled configuration.

15 Claims, 3 Drawing Sheets

FIG.1
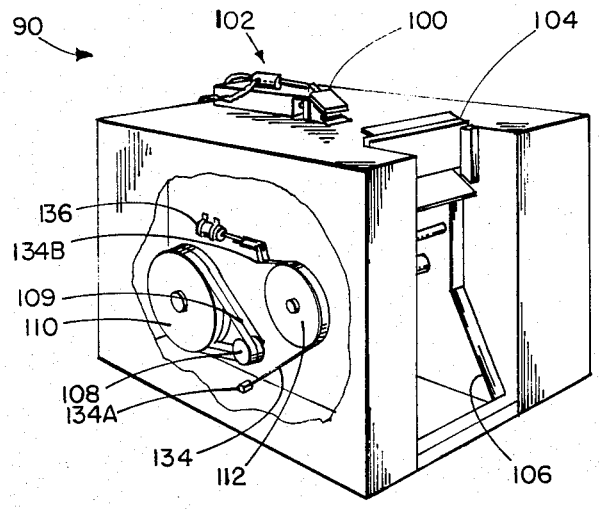
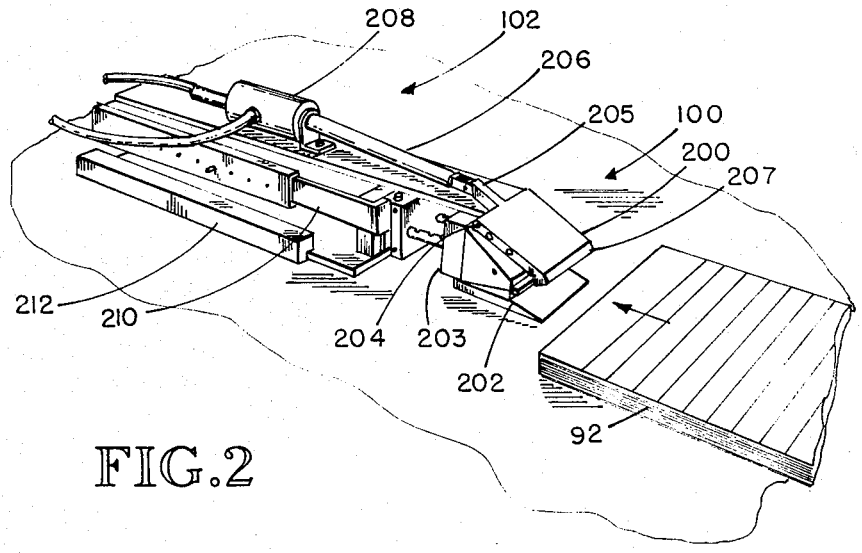
FIG.2

FIG.6
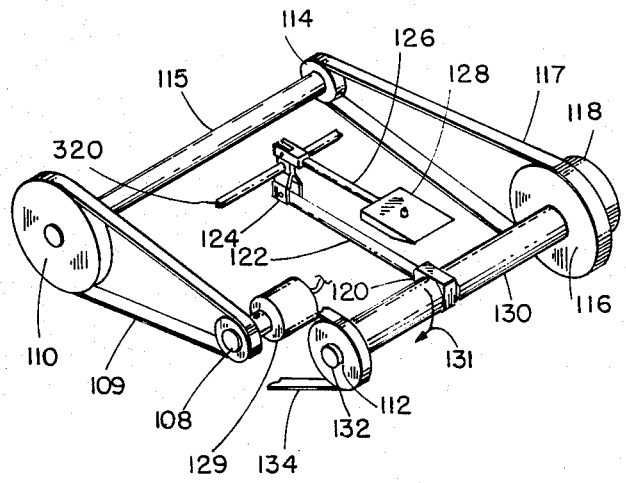
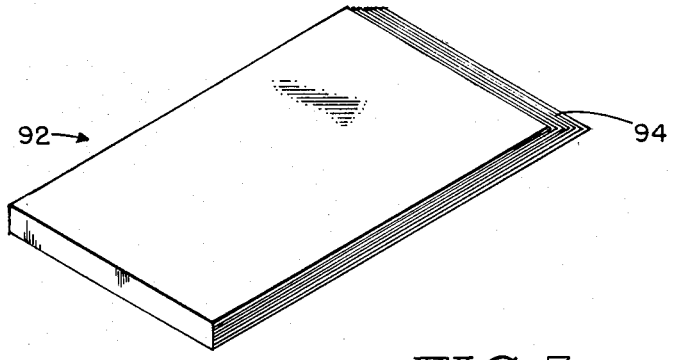
FIG.5

APPARATUS FOR PROVIDING BEVELED EDGE PADS

DESCRIPTION

1. Technical Field

The present invention is related to mechanical paper cutters and, more particularly, to apparatus and method for providing paper pads wherein the pads include a beveled edge.

2. Background of the Invention

Paper note pads have been used in all aspects of human life. Foremost of these is the use of paper pads in the workplace as well as educational institutions. For work related pads it is commonplace to find writing or drawings on the pads, apart from any message which might be placed on the pad by its user, which writings provide information to the user. The information typically provided may comprise identification of the user, dates, or advertising of the distributor of the pads. Of the more appealing of constructions for pads of this nature is a so called "Message Edged Pad" which displays a message along a beveled edge thereof. Such a Message Edged Pad is shown and described in Raymer, U.S. Pat. No. 3,817,492.

Raymer includes in his disclosure of the Message Edged Pad several methods for manufacturing the pad. However, none of the methods disclosed by Raymer are adequate for cost effective production of the Message Edged pad. Indeed since 1974 when the Raymer patent issued, the industry, including the owner of the Raymer patent, has been unable to produce the Message Edged Pad in a manner which is cost effective.

It is desirable, therefore, to provide method and apparatus which will allow for production of the Message Edged Pad in a manner which will facilitate cost effective production.

DISCLOSURE OF THE INVENTION

Apparatus and method of the present invention provides for cutting a stack of paper arranged in a substantially planar rectangular structure and having first and second ends. The sheets are cut in a manner to produce a Message Edged Pad, i.e., in a manner such that the second end thereof has a beveled edge.

A positioning assembly is provided for bending the pad by a predetermined amount. A gripping jaw is provided for gripping the first end of the pad such that the first end of each sheet of paper is prevented from moving relative to the the first end of the remaining sheets of paper. A reciprocal motion, jaw ram assembly is attached to the gripping jaw for moving the gripping jaw in bi-directional rectilinear motion such that the gripped pad engages the positioning assembly and is bent by the predetermined amount. A cutting knife is provided for cutting the second edge of the pad. The positioning assembly and the gripping jaw cooperate to prevent the pad from being moved while it is being cut. When the jaw ram assembly retracts the pad from the positioning assembly, such that the pad returns to its original planar structure, the second edge of the pad is beveled.

The invention further includes a novel method for cutting a paper pad and paper pads which are cut by the novel method. All of the subject matter which is regarded to be invention is particularly pointed out and distinctly claimed in the numbered paragraphs appended hereto. The invention, however, both as to organization and method of practice, may best be understood by reading the following detailed description, in conjunction with the drawings.

DETAILED DESCRIPTION OF DRAWINGS

FIG. 1 is a fragmentary, perspective view of the cutting apparatus which is the subject of the invention;

FIG. 2 is an enlarged, fragmentary perspective view of the pad gripping jaw and jaw ram assembly which comprise a portion of the novel cutting apparatus of FIG. 1;

FIG. 5 is a perspective view of the pad which results from cutting using the novel cutting apparatus which is the subject of the present invention; and FIG. 6 is an enlarged perspective view of the cutting knife and the crank which actuates the cutting knife of the present invention.

BEST MODE FOR CARRYING OUT THE INVENTION

Figures 3, 4:
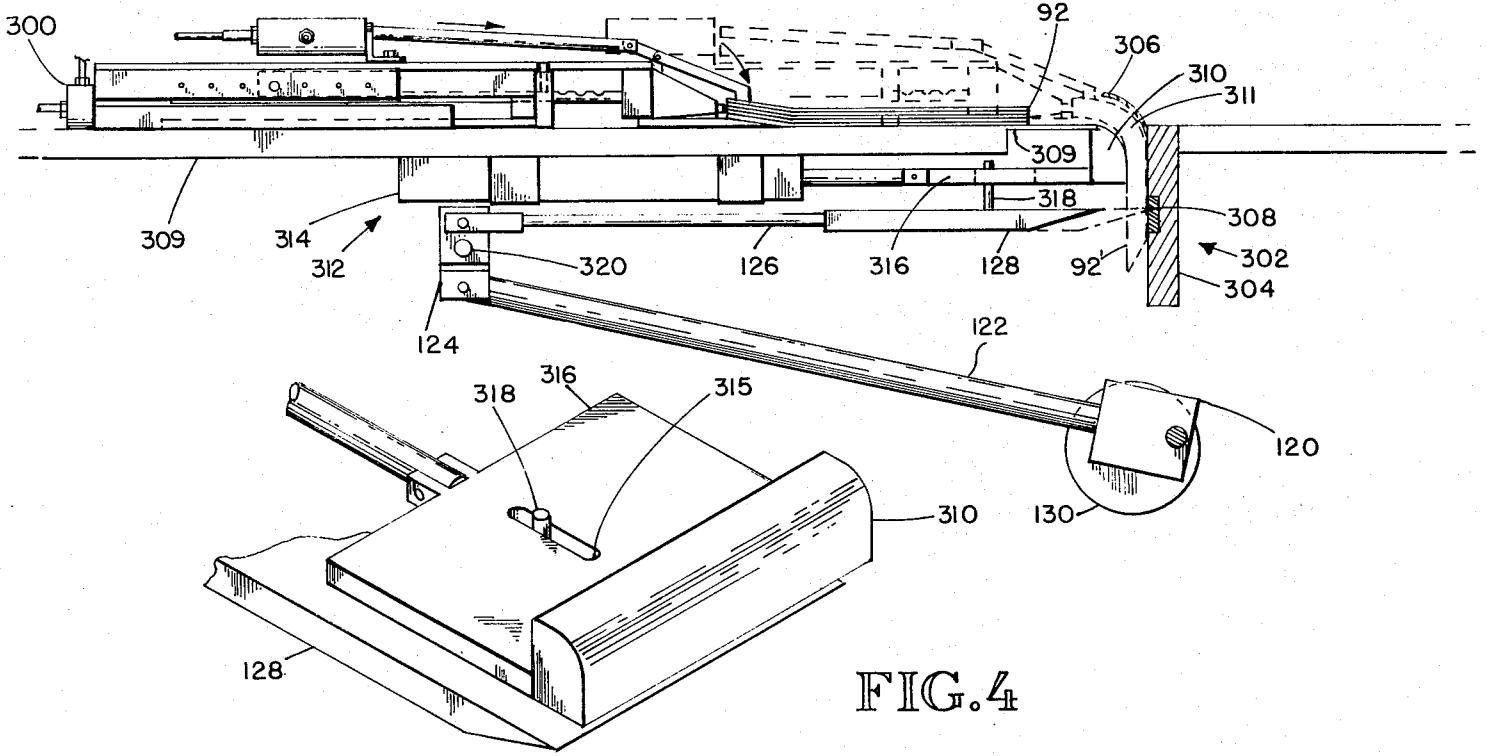
FIG. 3 is an enlarged, fragmentary perspective view of the cutting apparatus of FIG. 1 illustrating the cooperation of the positioning members and cutting knife with the pad gripping jaw and jaw ram assembly.
FIG. 4 is a fragmentary perspective view of the compression arm and knife of FIG. 3, illustrating the cooperation between the knife stem and the compression arm.

An apparatus 90 for cutting paper pads to provide a pad 92 which has a beveled edge 94 is illustrated generally in the figures. The apparatus 90 includes a pad gripping jaw 100 for gripping the uncut pads 92 and a jaw ram assembly 102 for moving the gripping jaw in bi-directional rectilinear motion. A gripped uncut pad 92 is moved toward a positioning assembly 104 which is configured to bend the pad by a predetermined angular amount. The positioning assembly acts in cooperation with the gripping jaw and the jaw ram assembly to move the pad to a forward cutting position (shown in FIG. 3 by the pad 92' in phantom lines) where the pad will be cut by a knife 128 to provide the beveled edge pad 92 or Message Edged Pad.

The cutting apparatus 90 further includes a start button (not shown) for initiating a cutting cycle, and as shown in FIG. 1, a bin 106 for receiving the cut off end portion of the pad. Cut portions of the pad leave the positioning assembly 104 and fall toward bin 106 under the influence of gravity. As referred to herein, a cutting cycle includes the operations necessary to cut a single pad. In the presently preferred embodiment, the start button is used to initiate a single cutting cycle. However, it will be apparent to those skilled in the art that the start button could be used to initiate more than one cutting cycle.

The operation of the pad gripping jaw 100, the jaw ram 102 and the cutting knife 128 during a cutting cycle is governed by a knife drive assembly. The drive assembly includes a motor 129 which rotatably drives a first pulley 108 which is connected to a second pulley 110 by a flexible drive belt 109. The second pulley 110 is connected to a third pulley 114 by a drive shaft 115, as best illustrated in FIG. 6. The third pulley 114 transmits rotational energy to a flywheel 116 through a drive belt 117. The flywheel 116 is chosen of much greater weight than either pulley 108, 110 or 114. As such, the flywheel stores energy supplied to it over a period of time in the form of rotational energy, which energy is used to supply drive force to the knife 128 to make a cut.

The flywheel 116 is selectively coupled to a shaft latch assembly 118 which is connected to a shaft 130. The shaft latch assembly includes a latch cylinder (not shown) which, in response to forward motion of the gripping jaw 100, engages the shaft latch assembly 118 with the flywheel 116 such that the shaft 130 begins to turn in the clockwise direction, as shown by the arrow 131 in FIG. 6. The latch cylinder is also responsive to a timing cam assembly 132 to disengage the shaft latch assembly 118 from the flywheel 116, as will be described below. In the presently preferred embodiment, the latch cylinder is activated at approximately one quarter turn of the shaft 130 in the clockwise direction 131 such that the shaft latch assembly 118 will be fully disengaged from the flywheel 116 after one full turn of the shaft 130.

A crank 120 responds to rotation of the shaft 130 to impart bi-directional rectilinear motion to a crank arm 122, as is known in the art. The crank arm 122 moves a pivoting member 124 pivotally mounted on a pivot pin 320 such that the pivoting member pivots about the pivot pin 320 in response to the bi-directional motion of the crank arm 122. The pivoting member thereby imparts bi-directional rectilinear motion to a knife arm 126 at the end of which is mounted the cutting knife 128.

The shaft 130 has coupled thereto a brake wheel 112 and the timing cam assembly 132 mentioned above. As shown in FIG. 1, the brake wheel 112 includes a frictional strap 134 partially wrapped thereabout. The strap 134 is held stationary by one end **134*a* and is attached by an opposite end 134*b* to a brake cylinder 136. The brake cylinder 136 is responsive to the timing cam assembly 132 to selectively apply tension to the frictional strap 134 such that the brake wheel 112 is frictionally engaged and the shaft 130 is stopped from rotating. The timing of the brake wheel 112 must be set such that the brake is applied to the shaft after the shaft latch assembly 118 disengages the shaft from the flywheel 116**.

In a normal cutting cycle, the shaft latch assembly 118 engages the shaft 130 to the flywheel 116 upon forward motion of the gripping jaw 100. Upon engagement, the knife 128 is powered by the flywheel 116 via the shaft 130, the crank 120, the crank arm 122, the pivoting member 124 and the knife arm 126. After one-quarter revolution of the shaft 130, the latch cylinder is returned to its normal position such that the shaft will be disengaged from the flywheel 116 after a full turn of the shaft. The knife 128 moves forward during a portion of the shaft rotation to an extended position as shown in phantom line in FIG. 3 to cut the pad 92 and is returned to its starting position shown in solid line in FIG. 3 by the completion of one revolution of the shaft. The brake 112 is applied, by activation of the brake cylinder 136, after the shaft is first disengaged from the flywheel by the shaft latch assembly 118, to stop the shaft from further rotating and hence to stop the movement of the knife with the knife in the starting position retracted from the pad.

The timing cam assembly 132 includes three control valves (not shown) which control the sequencing of the cutting knife drive assembly in response to rotation of a timing cam (not shown). A plurality of pneumatic cylinders (not shown) respond to the valves to initiate motion of the knife drive assembly described above.

Details of the cam assembly which is used in the present invention in conjunction with the control valves and the pneumatic cylinders to control mechanical motion can readily be provided by those skilled in the art. Accordingly, it will be appreciated by those skilled in the art that while the present invention is described by reference to a cam assembly in conjunction with pneumatic valves and cylinders, a number of electric, digital, magnetic and other motion control systems could be used without departing from the true scope of the invention.

It will also be appreciated by those skilled in the art that the knife drive assembly described above may be comprised of many structures which are known in the art. As an example, the pneumatic cylinders may be replaced with electro-magnetic devices. Further, disk brakes may replace the brake disclosed herein and a clutch mechanism may be used for the shaft latch assembly disclosed above. Many other alternatives for providing the knife drive assembly described herein will readily become apparent to those skilled in the art.

With reference to FIG. 2, a more detailed illustration of the pad gripping jaw 100 and the jaw ram assembly 102 is provided. The pad gripping jaw 100 includes first and second gripping members 200 and 202, coupled to a jaw frame 203. The first gripping member 200 includes a projecting lever portion 205 and a clamping portion 207. The first gripping member 200 is pivotally attached to the jaw frame 203 by a pivot pin 204 such that the projecting lever portion 205 and the clamping portion 207 extend outward from the pivot pin 204 in opposite directions. The second gripping member 202 is fixedly attached to the jaw frame 203. The first gripping member 200 is thereby adapted to pivot about the pivot pin 204 relative to the jaw frame 203 to move the first gripping member toward or away from the second gripping member to selectively grip and release a pad 92 therebetween.

A gripping drive arm 206 is pivotally coupled to the projecting lever portion 205 of the first gripping member 200. The gripping arm 206 is attached to and reciprocates in response to a gripping drive cylinder 208 to pivot the first gripping member about the pivot pin 204 relative to the jaw frame 203. In this manner, the first gripping member 200 of the jaw 100 is responsive to the operation of the gripping cylinder 208 to grip a pad 92 between the first and second gripping members 200 and 202 such that the sheets of paper located therebetween are held stationary with respect to one another.

The jaw ram assembly 102 further includes a ram support assembly 210 and a ram support assembly guide 212. A ram cylinder 300 (see FIG. 3) is provided which imparts bi-directional rectilinear motion to the ram support assembly 210. The jaw frame 203, including the first and second gripping members 200 and 202 attached thereto, and the gripping drive cylinder 208 are mounted to the ram support assembly 210 for travel therewith. The movement of the ram support assembly 210, guided by the ram support assembly guide 212 is toward and away from the positioning member 104 to carry the pad 92 when locked within the pad gripping jaw 100 between a forward position where the pad is cut and a rearward position where the pad is away from the positioning member and the knife 128 for insertion or removal of the pad from between the first and second gripping members 200 and 202 of the jaw.

The jaw ram assembly 102 further includes first and second ram valves (not shown). The first ram valve responds to initial motion of the ram support assembly to actuate the gripping cylinder 208 such that a pad is gripped after the ram support assembly 210 begins its forward motion to the forward position. The second ram valve actuates the shaft latch assembly 11 to begin the cutting motion of the knife 128 (as described above) after the ram support assembly has moved the pad to the forward cutting position.

The ram cylinder responds to the timing cam assembly 132 to retract the ram support assembly 210 after the knife 128 has complete qts cut, i.e., after approximately one full turn of the shaft 130.

The positioning assembly 104 shown generally in FIG. 1 is shown more clearly in FIG. 3, and includes a stationary cutting fixture 302 and a compression assembly 312 which is adapted to compress the uncut pad 92 against the cutting fixture before the pad is cut. The compression assembly 312 in conjunction with the cutting fixture 302 act to position the pad to be cut, i.e., to bend the pad a predetermined angular amount so as to produce the beveled effect when cut by the knife and to hold the pad in the bent position while it is being cut.

The compression assembly 302 includes a compression cylinder 314 which provides constant force to a compression head 310 via an extensible compression arm 316. As shown in FIG. 4, the compression arm 316 is a relatively planar member with an aperture 315 through which a stem 318 of the knife 128 extends, the knife being positioned below the compression arm and both moving in generally parallel planes to and away from the cutting fixture 302. As the knife 128 moves forward, the compression arm 316 also moves forward, powered by the compression force provided from the compression cylinder 314. The compression head 310 impacts the pad 92 and stops moving. The knife continues to move forward beyond the forwardmost travel of the compression head to cut the pad. When the knife 128 is retracted, the stem 318 engages the compression arm 316 as it moves rearward and moves the compression arm back, such that the compression head 310 releases the pad.

The cutting fixture assembly 302 includes a cutting bar 304 and a curved guide plate 306. The curved guide plate 306 is provided for engaging the pad as it is moved along a planar table surface 309 by the gripping jaw 100. The curved guide plate 306 is positioned forward of a slot 311 provided in the table surface 309 and curves rearward toward the gripping jaw 100 so that as the gripping jaw moves the uncut pad 92 forward, the forwardmost end the pad is engaged by the guide plate and deflected downward through the slot into position adjacent to the cutting bar 304. The gripping jaw 100 continues to grip and hold a rearward end portion of the pad generally parallel, although slightly angled relative to the table surface 309. In such manner, the predetermined amount of bending is provided to the pad. The compression head 310 is then extended to clamp the pad between the compression head and the cutting bar 304 in preparation for the cut. The cutting bar 304 also provides support to the pad against the cutting forces of the the knife 128 against the pad. The cutting bar 304 includes a poly pak 308 for receiving the tip of the knife 128 to prevent damage to the knife.

The cutting procedure which forms the beveled edge of the pad will now be explained. It is noted that with the pad flexed by being bent, the free ends of the sheets of paper comprising the pad 92 are shifted out of registration. With the pad clamped in this arrangement against the cutting bar 304 by the compression head 310, and knife 128 is moved quickly forward in a plane parallel to the table surface 309 to cut the pad at a right angle relative to the pad sheets toward the pad free end but sufficiently away from the pad free end so as to cut all sheets of the pad. While this makes a conventional right angle cut of the pad free end when in such a bent arrangement each sheet is actually cut to a different length and when the pad is retracted and returned to a normal, fully planar configuration, the cut free end of the pad will assume the desired shape of the beveled edge 94. Thus, a convenient, quick right angle cut is used to form the beveled edge.

It will be appreciated by those skilled in the art that by contouring the shape of the compression head to match that of the curvature plate these two elements cooperate to provide the predetermined amount of bend to the pad to be cut. Further, the amount which the pad is bent while it is cut will determine the resultant angle of the beveled edge. Accordingly, amount of bend which is provided to the pad (and hence the resultant angle of the beveled edge) can be altered by altering the curvature of the compression head and the curvature plate. It is desirable, however, that the contour of the compression head match that of the curvature plate so that the two elements will securely hold the pad while it is being cut.

In an alternative embodiment, the cutting bar may include a channel for receiving the compression head. In such an embodiment, the positioning assembly can provide various amounts of bend to the pad. Many other alternative shapes for the compression head and the curvature plate will readily become apparent to those skilled in the art.

A particular advantage to the method of providing the beveled edge which is disclosed as the subject invention is that each sheet of paper is cut perpendicularly instead of at an angle. When the pad is returned to its original planar configuration, a small portion of the cut edge of each sheet of paper is visible and the full message remains visible by the viewer even as sheets are torn from the pad. In the case where the edge to be cut has been printed, as is the Message Edged Pad, a portion of the message contained on each sheet of paper is visible. This method, therefore, further enhances the appeal of the Message Edged Pad.

It should be apparent to those skilled in the art that various arrangements for bending and cutting the pad can be configured which are within the scope and spirit of the invention. As an example, the cutting assembly, including the curvature plate, may be adapted to engage the pad instead of the pad being moved to engage the curvature plate. Also, the jaw may be replaced with a variety of arrangements for gripping the uncut end of the pad such that the sheets of paper located at the uncut end are unable to move relative to one another. Many other alternative embodiments will readily become apparent to those skilled in the art.

Therefore, while only several presently preferred embodiments of our novel method and apparatus for providing beveled edge pads have been described in detail herein, many modifications and variations thereof will readily become apparent to those skilled in the art. It is our intention, therefore, by the claims appended hereto, to embody all such modifications and variations as fall within the true scope and spirit of the invention.

We claim:

1. Apparatus for cutting paper pads of the type which include a plurality of stacked sheets of paper arranged in a substantially planar configuration and having opposed first and second ends, said apparatus being constructed for cutting the pads in a manner such that the cut pad includes a beveled edge at the second end, said apparatus comprising:

bending means for bending the pad intermediate its first and second ends by a predetermined angular amount, said bending means including means for securely holding the pad in the bent configuration while it is being cut;

gripping means for gripping the first end of the ad such that the gripped end of the sheets of paper are unable to move relative to one another;

ram means for bi-directionally moving said gripping means between a first position and second position, with movement of said gripping means from said second position to said first position causing the pad to move linearly thereby to engage said bending means to place the pad in the bent configuration and movement of said gripping means from said first position to said second position causing the pad to disengage said bending means to place the pad in its original configuration; and cutting means for cutting off a portion of the pad toward the second end when the pad is in the bent configuration, the cut being made along a direction which is perpendicular to the pad sheets such that when the pad is disengaged from said bending means and returned to its original planar configuration, the cut second end of the pad is beveled.

2. Apparatus as recited in claim 1 wherein said bending means comprises:

a stationary cutting bar;

a curvature plate having a curvilinear cross-section positioned at an upper portion of said cutting bar, said curvature plate extending upward from said cutting bar and bending toward said gripping means such that when said gripping means is moving the pad toward said bending means the pad engages said curvature plate and bends along the path defined by said curvature plate and said cutting bar; and a compression assembly for compressing the pad against said cutting bar for cutting of the pad.

3. Apparatus as recited in claim 2 wherein said compression assembly comprises a compression head positioned opposite said cutting bar for engaging the pad when the pad is in said first position between said compression head and said cutting bar, a compression arm coupled to the compression head and a compression cylinder, selectively providing constant compressive force to said compression head through said compression arm.

4. Apparatus as recited in claim 3 wherein said cutting means comprises:

a knife;

a knife arm; and a knife drive assembly for selectively imparting bi-directional motion to said knife through said knife arm for moving said knife toward the pad for cutting engagement therewith and away from the pad.

5. Apparatus as recited by claim 4 wherein said knife arm includes a stem which is coupled thereto and extends therefrom, and said compression arm includes an aperture for receiving said stem, said knife drive assembly being adapted to apply a retraction force on said compression arm via said knife arm stem and compression arm aperture to retract said compression head away from engagement with the pad upon movement of said knife away from the pad.

6. Apparatus as recited in claim 1 wherein said gripping means comprises:

first and second jaw members coupled to a jaw frame, said second jaw member being substantially stationary relative to said jaw frame and said first jaw member being pivotally connected to said jaw frame, said first and second jaw members extending beyond said jaw frame to receive the pad therebetween with the pad abutting said jaw frame, said first jaw member being pivotal with respect to said second jaw member to selectively and releasably grip the pad between said first and second jaw members.

7. Apparatus as recited in claim 6 wherein said gripping means further includes a gripping cylinder coupled to said first jaw member through a gripping arm, and wherein said first jaw member includes a coupling member, said gripping arm being responsive to said gripping cylinder to impart bi-directional motion to said coupling member to pivot said first jaw member with respect to said second jaw member.

8. Apparatus for cutting paper pads of the type which include a plurality of stacked sheets of paper arranged in a substantially planar configuration and having opposed first and second ends, said apparatus being constructed for cutting the pad in a manner such that the cut pad includes a beveled edge at the second end thereof, said apparatus comprising:

a gripping assembly for gripping the first end of the pad such that the sheets of paper are unable to move relative to one another, said gripping assembly including first and second jaw members coupled to a jaw frame, said second jaw member being substantially stationary relative to said jaw frame and said first jaw member being pivotally connected to said jaw frame, said first and second jaw members extending beyond said jaw frame to receive the pad therebetween with the pad abutting said jaw frame, said first jaw member being pivotal with respect to said second jaw member to selectively and releasably grip the pad between said first and second jaw members, said gripping assembly further including a gripping cylinder coupled to a coupling member of said first jaw member for imparting bi-directional motion to said coupling member to pivot said first jaw member with respect to said second jaw member;

a horizontal support surface having opposed first and second ends, said gripping assembly being mounted upon said support surface;

a stationary bending assembly spaced from the first end of said support surface, said bending assembly including a substantially planar cutting bar and a curvature plate positioned at an upper portion of said cutting bar, said cutting bar being positioned substantially perpendicular to said support surface and extending below said support surface, said curvature plate extending upward from said cutting bar and above said support surface and bending toward said gripping assembly to define a slot between said support surface and said bending assembly for receiving the pad;

a ram assembly for bi-directionally moving said gripping assembly between a first position located at said first end of said support surface and a second position such that when a gripped pad is moved toward the first position it engages said bending assembly and is deflected through the slot along said cutting bar;

a compression assembly for compressing the pad against said cutting bar for cutting of the pad, said compression assembly including a compression head positioned opposite said cutting bar for engaging the pad when the pad is in the first position between said compression head and said cutting bar and a compression cylinder selectively providing constant compressive force to said compression head;

a knife for cutting the pad when the pad is at the first position; and a knife drive assembly for selectively imparting bi-directional motion to said knife for moving said knife toward the pad for cutting engagement therewith and away from the pad, the cut being made along a direction which is perpendicular to the pad sheets when the pad is at the first position such that when the pad is returned to its original planar configuration, the cut end of the pad is beveled.

9. Apparatus for cutting paper pads of the type which include a plurality of stacked sheets of paper arranged in a substantially planar configuration and having opposed first and second ends, said apparatus for cutting the pads in a manner such that the cut pad includes a beveled edge at the second end, said apparatus comprising:

gripping means for gripping a first end of the pad, said gripping means including means for linearly moving the gripped pad;

bending means for bending the pad intermediate its first and second ends and for holding the pad in the bent configuration while it is being cut, said gripping means being adapted to move the gripped pad into engagement with said bending means thereby to bend the pad; and means for cutting a portion at the second end of the pad while the pad is in the bent configuration such that when the pad is disengaged from the bending means and returned to its original planar configuration, the cut second end of the pad is beveled.

10. Apparatus as recited in claim 9 wherein said gripping means further comprises ram means for moving said gripping means in bi-directional motion such that movement of said gripping means from a first position to a second position causes the pad to engage said bending means and to bend the pad thereby to conform the pad to the bent configuration and such that movement of said gripping means from the second position to the first position causes the pad to disengage said bending means and return to its original planar configuration.

11. Apparatus as recited in claim 10 wherein said bending means further comprises:

a stationary cutting bar;

a curvature plate having a curvlinear cross-section positioned at an upper portion of said cutting bar, said curvature plate extending upward from said cutting bar and bending toward said gripping means such that when said gripping means is moving the pad toward said bending means the pad engages said curvature plate and bends along the path defined by said curvature plate and said cutting bar; and a compression assembly for compressing the pad against said cutting bar for cutting of the pad.

12. Apparatus as recited in claim 11 wherein said compression assembly comprises a compression head positioned opposite said cutting bar for engaging the pad when the pad is in said first position between said compression head and said cutting bar, a compression arm coupled to the compression head and a compression cylinder, selectively providing constant compressive force to said compression head through said compression arm.

13. Apparatus as recited claim 12 wherein said cutting means comprises:

a knife;

a knife arm; and a knife drive assembly for selectively imparting bi-directional motion to said knife through said knife arm for moving said knife toward the pad for cutting engagement therewith and away from the pad.

14. Apparatus as recited in claim 13 wherein said gripping means comprises:

first and second jaw members coupled to a jaw frame, said second jaw member being substantially stationary relative to said jaw frame and said first jaw member being pivotally connected to said jaw frame, said first and second jaw members extending beyond said jaw frame to receive the pad therebetween with the pad abutting said jaw frame, said first jaw member to selectively and releasably grip the pad between said first and second jaw members.

15. Apparatus as recited in claim 14 wherein said jaw means further includes a gripping cylinder coupled to said first jaw member through a gripping arm, and wherein said first jaw member includes a coupling member, said gripping arm being responsive to said gripping cylinder to impart bi-directional motion to said coupling member to pivot said first jaw member with respect to said second jaw member.

* * * * *

UNITED STATES PATENT AND TRADEMARK OFFICE

CERTIFICATE OF CORRECTION

PATENT NO. : 4,854,202

DATED : August 8, 1989

INVENTOR(S) : Donald R. McNab; Floyd D. Smith

It is certified that error appears in the above-identified patent and that said Letters Patent is hereby corrected as shown below:

In claim 1, column 7, line 10, delete "ad" and substitute therefor --pad--.

In claim 5, column 8, line 1, delete "away" before "from".

In claim 14, column 10, line 43, following "jaw member" insert --being pivotal with respect to said second jaw member--.

Signed and Sealed this

Fifth Day of June, 1990

*Attest:*

HARRY F. MANBECK, JR.

*Attesting Officer*

*Commissioner of Patents and Trademarks*